United States Patent [19]

Walker

[11] 4,192,408

[45] Mar. 11, 1980

[54] WHEELED SUPPORT FOR SUITCASES AND LIKE ARTICLES

[76] Inventor: Brooks Walker, 1280 Columbus Ave., San Francisco, Calif. 94133

[21] Appl. No.: 964,032

[22] Filed: Nov. 27, 1978

[51] Int. Cl.[2] ..... A45C 5/14

[52] U.S. Cl. ..... 190/18 A

[58] Field of Search ..... 190/18 A; 280/47.13 R, 280/47.24, 47.26

[56] References Cited

U.S. PATENT DOCUMENTS 4,026,570 5/1977 Feinberg ..... 190/18 A

FOREIGN PATENT DOCUMENTS 2212232 9/1973 Fed. Rep. of Germany ..... 190/18 A 2255655 5/1974 Fed. Rep. of Germany ..... 190/18 A 1240325 11/1959 France ..... 190/18 A 403180 6/1966 Switzerland ..... 190/18 A

*Primary Examiner*—Donald F. Norton

*Attorney, Agent, or Firm*—Gordon Wood

[57] ABSTRACT

A wheeled support for carrying articles such as suitcases, trunks, sample cases and the like which may be readily installed on conventional carrying articles without requiring a great deal of skill. An aperture is cut in one corner at which two sidewalls intersect and a wheel housing is secured at such aperture. Adequate stability may be achieved by applying a pair of spaced apart housings along a long corner of the article to be wheeled.

7 Claims, 5 Drawing Figures

70
15
12
10
13
14
22
31
11
3
20
48
46
27
40
50
21
25
45
44
41
42
33
28
60
61
50'
33'
30

WHEELED SUPPORT FOR SUITCASES AND LIKE ARTICLES

This invention relates to wheeled articles such as suitcases and the like and is particularly directed to a means for rotatably supporting ground wheels at space points along the length of a corner at which two sides of the article intersect.

Various types of wheeled suitcases are presently on the market, and means for mounting the wheels take various forms. However, heretofore no inexpensive, easily installed means has been provided for attaching ground wheels to a conventional suitcase which is manufactured without ground wheels. The main object of the present invention is the provision of an extremely simple method and means for mounting ground wheels on an existing suitcase or like article.

Another object of the invention is the provision of a wheel mount for suitcases and like articles which may be installed by a person having very little skill and which mount does not interfere with packing the interior of the suitcase to any great degree.

Still another object of the invention is the provision of a wheel mount wherein less than one-half the wheel extends outwardly of the mount to reduce or eliminate the likelihood of the wheel being damaged or knocked off when it is struck by an object during transportation by conveyor or during handling.

Yet another object of the invention is the provision of ground wheels for suitcases and the like which are adapted to be installed at spaced points along a corner of the suitcase so as to enhance the stability of the suitcase while being wheeled.

Another object is the provision of a wheel mount for a suitcase which requires only one screw to hold it in place.

Other objects and advantages will be apparent from the following specification and from the drawings.

Figures 1, 2, 3, 4, 5:
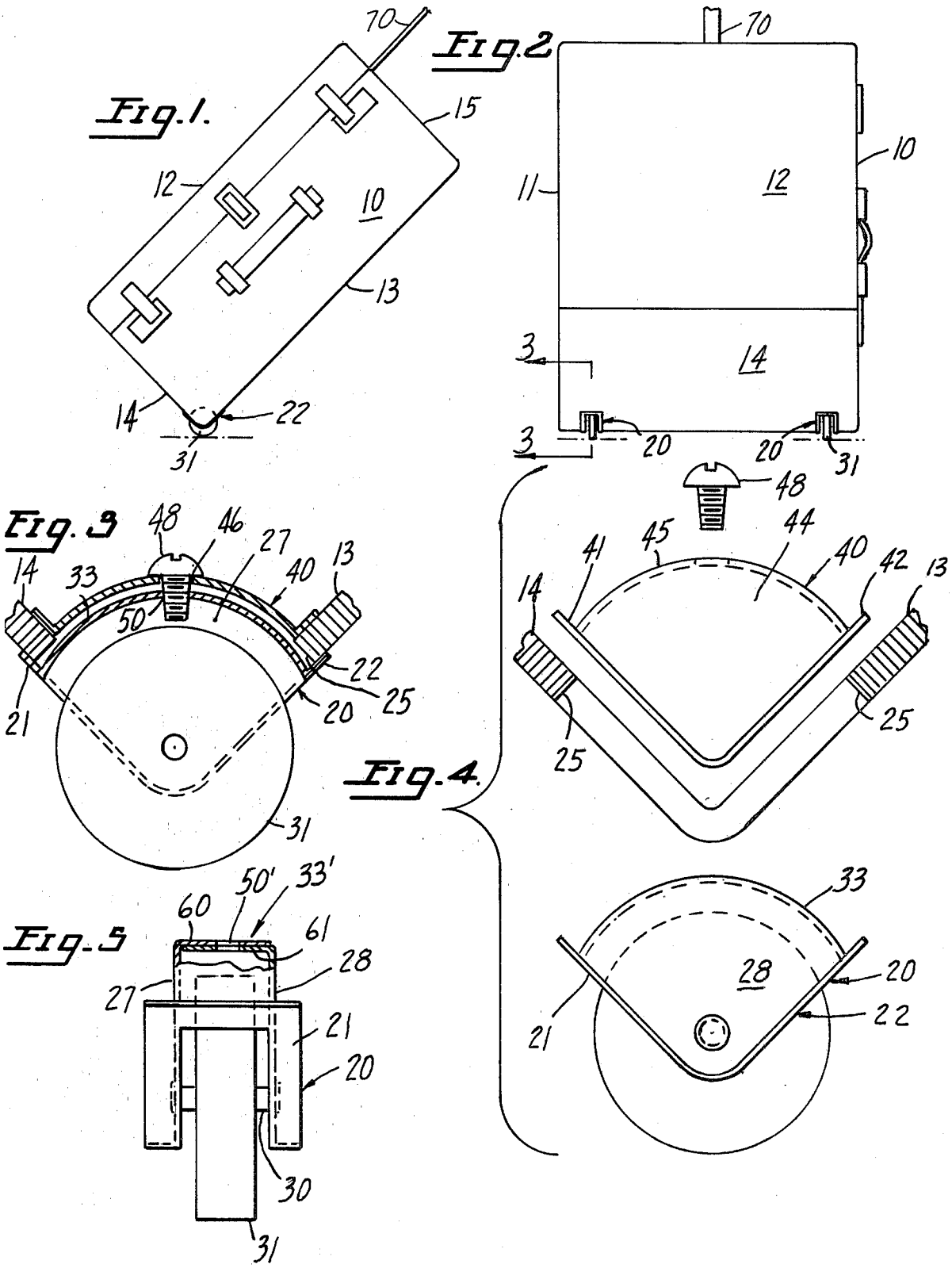
FIG. 1 is a side elevation of a suitcase showing the invention in use.
FIG. 2 is a front elevation of the suitcase of FIG. 1.
FIG. 3 is a section through the lower corner of the suitcase as taken in a plane indicated by lines 3—3 of FIG. 2.
FIG. 4 is an exploded view of the various parts constituting the invention before assembly.
FIG. 5 is a front elevation of the wheel mount of FIG. 4 showing an alternative method of forming the wheel mount.

The invention is adapted to be employed with a suitcase or like article having top and bottom walls 10, 11, respectively, opposite sidewalls 12, 13 and opposite endwalls 14, 15.

The present invention lends itself to use on a long corner of the suitcase such as the corner between intersecting end wall 14 and sidewall 13. The means for mounting a wheel includes a faceplate generally designated 20 which includes a pair of portions 21, 22 in intersecting planes and formed so as to abut the marginal portions of endwall 14 and sidewall 13 surrounding an opening 25 formed at the juncture between endwall 14 and sidewall 15 (see FIG. 4). Such opening may be conveniently formed by means of a punch, sabre saw or suitable cutting tool.

Fixedly secured to the right angle faceplate 29 are a pair of cheek plates 27, 28 between which extends a shaft 30 which may be upset or riveted at its ends to said cheek plates for rotatably supporting a wheel 31. Connecting said cheek plates 27, 28 is an inner arcuate wall 33 which functions to close the inner side of the wheel mount against entrance of moisture or dirt into the suitcase.

For the purpose of securing the wheel mount to the suitcase an inner clamping member generally designated 40 is provided (FIG. 4). Said clamping member is also provided with a faceplate that is similar to faceplate 22 and having right angle portions 41, 42 which are adapted to abut the inner marginal portions of the endwall 14 and sidewall 13 surrounding aperture 25. Clamping member 40 is provided with a pair of sidewalls 44 similar to cheek plates 27, 28 of the wheel mount and is also provided with an arcuate inner wall 45 similar to inner wall 33 of the wheel mount. Centrally of the inner wall 45 the same is provided with an opening 46 (FIG. 3) for receiving therethrough a self-tapping screw 48. The inner wall 33 of the wheel mount is provided with a smaller hole 50 for threadedly receiving the self-tapping screw therethrough so that the wheel mount and the clamping member may be urged toward each other, as best seen in FIG. 3, clamping the endwall 14 and sidewall 13 therebetween. More than one self-tapping screw 48 may be employed if desired.

It will be noted that the outside faceplate 22 seals the suitcase against entrance of dirt or moisture.

Although the wheel mount 20 and clamping member 40 may be formed of relatively light gauge sheet metal with the parts welded together or deep drawn by suitable dies or cast of suitable material, an alternative method is shown in FIG. 5 wherein in lieu of the integral inner wall 33 an inner wall 33' is provided which is formed by flanges 60, 61 integral with cheek plates 27, 28 respectively. Said flanges 60, 61 may be readily spot welded together and a hole 50' may be formed in the assembly to receive the self-tapping screw 48. In certain instances the structure of FIG. 5 facilitates assembly of the wheel mount. A similar method of assembly may be employed in forming clamping member 40 if desired.

It will be apparent from FIGS. 1 and 2 that the installation of the wheels on a long corner of the suitcase provides an extremely stable structure. In this connection it will be understood that if the wheels were mounted on a short corner, such as that between bottom wall 11 and end wall 14, there would be a greater tendency for the suitcase to tip over laterally when being wheeled even if the added load is in a plane between such closely spaced wheels. This is especially so if a camera, tote bag, or other object is suspended over the handle of the suitcase thus shifting the center of gravity of the assembly to one side.

The suitcase may be drawn by a tether 70 or other suitable means.

It will be apparent that other means may be employed to clamp the side 11 between the wheel mount and the clamping means. A fast setting adhesive between the respective sidewalls of the parts may be used or blind rivets may be employed.

In the case of soft-side suitcases localized stiffening of the wheel housing may be effected by inserting a U-shaped spacer of wood, plastic or other suitable rigid material between the sidewall of the suitcase and the clamping member 40.

I claim:

1. In a carrying article, such as a suitcase, having a pair of walls in intersecting relation defining a corner, a wheel housing for such article comprising:

an exterior wheel mount adapted to be partially received within an opening in said corner, said mount including a faceplate formed to provide a pair of portions in intersecting planes and adapted to engage the outer surfaces of said walls respectively in face to face relationship, a clamping member within said article and including a faceplate adapted to engage the inner surfaces of said walls in face to face relationship, and means for holding said mount and said member together with said walls clamped therebetween.

2. A structure according to claim 1 wherein said mount includes a pair of integral cheek plates, a shaft carried by said cheek plates, and a wheel rotatably supported on said shaft.

3. A structure according to claim 2 wherein said mount includes a guard plate inwardly of said cheek plates.

4. A structure according to claim 1 wherein said means for holding said mount and member together comprises a screw threadedly received in said mount.

5. In a suitcase having relatively narrow opposite top and bottom walls and vertically extending opposite sidewalls and end walls, a pair of wheel housings spaced apart along a corner formed by an end wall and an adjacent sidewall, each of said housings including a wheel mount engaging the outer surfaces of the walls of said corner and a clamping member engaging the inner surfaces of said walls.

6. A suitcase according to claim 5 wherein openings are formed in said walls at said corner for partially receiving said wheel mounts therein.

7. A structure according to claim 6 wherein said mounts each include a pair of cheek plates, a pin extending between said plates and a wheel rotatably supported on said pin.

* * * * *